US006779788B2

(12) United States Patent
Takahashi et al.

(10) Patent No.: US 6,779,788 B2
(45) Date of Patent: Aug. 24, 2004

(54) APPARATUS FOR FOLDING PRINTED PAPER SECTIONS

(75) Inventors: Yukitoshi Takahashi, Kanagawa (JP); Hiroyuki Fujinuma, Tokyo (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 0 days.

(21) Appl. No.: 10/446,651

(22) Filed: May 29, 2003

(65) Prior Publication Data

US 2004/0053762 A1 Mar. 18, 2004

(30) Foreign Application Priority Data

Sep. 17, 2002 (JP) ..... 2002-270294

(51) Int. Cl.[7] ..... B41F 13/56

(52) U.S. Cl. ..... 270/20.1; 270/4; 270/21.1; 493/424

(58) Field of Search ..... 270/4, 5.02, 8, 270/20.1, 21.1; 493/356, 360, 405, 419, 424, 425, 426; 83/115; 101/216, 409, 415.1

(56) References Cited

U.S. PATENT DOCUMENTS 4,564,183 A * 1/1986 Müller ..... 270/21.1
5,425,697 A * 6/1995 Lanvin ..... 493/426
5,503,071 A * 4/1996 Hillebrand et al. ..... 101/409
6,125,728 A * 10/2000 Hillebrand ..... 83/115
6,128,988 A * 10/2000 Hillebrand ..... 83/115
6,279,890 B1 * 8/2001 Tomczak ..... 270/21.1

FOREIGN PATENT DOCUMENTS

JP 63-189367 A1 8/1988
JP 7-89669 * 4/1995
JP 11-156794 * 6/1999

* cited by examiner

*Primary Examiner*—Eugene H. Eickholt
(74) *Attorney, Agent, or Firm*—Rader, Fishman & Grauer PLLC

(57) ABSTRACT

A web of printed paper is cut into sections by a cutting cylinder while riding on a folding cylinder, and each paper section has its midpart subsequently pushed by a folding blade on the folding cylinder into a jaw cavity formed in the surface of a jaw cylinder in order to be folded into the form of a signature while being transferred from the folding cylinder onto the jaw cylinder. Mounted adjacent the opposite ends of the jaw cavity in the jaw cylinder are a pair of hooks which are cammed into and out of the space that is created by the midpart of each paper section upon insertion in the jaw cavity. The paper section has its midpart positively retained in the jaw cavity while being folded. A set of fixed and movable jaws is also provided in the jaw cavity and functions mostly to fold the paper section rather than to grip the same against accidental detachment.

8 Claims, 8 Drawing Sheets

APPARATUS FOR FOLDING PRINTED PAPER SECTIONS

BACKGROUND OF THE INVENTION

1. Field of the Invention

This invention relates to a folding device built into or appended to a web-fed printing press, as in newspaper production, for giving a down-the-middle fold to a web or webs of printed paper, cutting the web or webs into sections, and folding the successive paper sections across the middle into the form of signatures. More particularly, the invention deals, in the folding device of the rotary printing press, with a jaw cylinder having one or more jaw cavities formed in its surface parallel to the cylinder axis for receiving the midpart of each paper section to be folded.

2. Description of the Prior Art

Japanese Unexamined Patent Publication No. 63-189367 is hereby cited as showing the typical construction of the folding station of a web-fed printing press. Mounted parallel to one another at the folding station are a cutting cylinder, a folding cylinder and a jaw cylinder, all in constant rotation at the same circumferential velocity during the progress of printing. The printed web or webs of paper are first wrapped around part of the folding cylinder and, while traveling thereover, cut into successive sections by cutting blades on the cutting cylinder which is held against the folding cylinder via the web or webs. The cutting blades cut the web or webs by being engaged in grooved anvils or beds on the folding cylinder. Each paper section subsequently travels over the folding cylinder by having its leading edge pierced by a series of retractable pins on the surface of the folding cylinder.

The folding cylinder is additionally equipped with elongate folding blades each extending parallel to the folding cylinder axis and arranged at circumferential spacings thereon. Each folding blade is movable radially of the folding cylinder for pushing the paper section into one of the elongate jaw cavities which are formed in the surface of the jaw cylinder at constant circumferential spacings.

Pushed off the surface of the folding cylinder by one of the folding blades, the paper section has its midpart placed between a fixed and a movable jaw in one jaw cavity. The midpart of the paper section is then captured, together with the folding blade, between the fixed and movable jaws as the movable jaw is closed against the fixed jaw. The paper section is subsequently carried away from the surface of the folding cylinder by the jaw cylinder as these cylinders continue rotation in opposite directions. The folding blade withdraws from between the folds of the midpart of the paper section, leaving the same sandwiched between the fixed and the movable jaw thereby to be creased. The paper section is subsequently folded along the centerline as the leading half of the paper section is doubled over its trailing half while being carried away from the folding cylinder onto the jaw cylinder.

There has been a problem left unsolved in conjunction with the engagement of the paper section between each set of fixed and movable jaws on the jaw cylinder. The paper section has its midpart held caught between the fixed and the movable while being transferred from the folding to the jaw cylinder and doubled over itself, until it is carried by the jaw cylinder to the preassigned angular position from which the folded paper section is deposited on a delivery conveyor. Considerable frictional resistance is exerted on the paper section as the latter is pulled off the surface of the folding cylinder onto the jaw cylinder. The jaws are required to grip the paper section against the risk of accidental disengagement in the face of such frictional resistance.

The paper sections are literally fresh from the press, however. Ink offset has been easy to occur between the contacting surfaces of each paper section when the same is caught strongly by the jaws, and particularly when the folding blade is being withdrawn from the folds of the paper section. This is because the folding blade rubs hard against the paper sections, behaving as if prying open the jaws, as it withdraws from between the jaws by the rotation of the jaw cylinder and folding cylinder in opposite directions. The ink offset must be avoided by any means as it represents a serious impairment of printing quality and a degradation of the commercial values of the printings.

SUMMARY OF THE INVENTION

The present invention seeks to make it unnecessary for the paper sections to be bitten by the jaws so hard as to cause ink offset between their contacting surfaces and, at the same time, to preclude the likelihood of the paper sections accidentally falling off the jaw cylinder while being folded thereon.

Stated briefly, the invention concerns a folding station downstream of one or more printing stations of a web-fed printing press. The folding station is such that a web of printed paper or two or more such webs in superposition are cut into sections by a cutting cylinder while traveling on a folding cylinder. Each paper section has its midpart subsequently pushed off the folding cylinder into a jaw cavity in a jaw cylinder in order to be folded into a signature while being transferred from the folding cylinder onto the jaw cylinder.

More specifically, the invention deals with the jaw cylinder comprising a pair of hooks mounted adjacent the opposite ends of the jaw cavity in the jaw cylinder for movement into and out of a space created by the midpart of each paper section upon insertion in the jaw cavity. The hooks are driven by hook drive means to enter the space bounded by the midpart of each paper section when the same is inserted in the jaw cavity, and to withdraw from the space after the paper section has been folded on the jaw cylinder.

In a preferred embodiment of the invention to be disclosed herein, the hooks are each driven into and out of hooking engagement with the inserted midpart of each paper section by a cam of arcuate or annular shape affixed to the frame means to which the jaw cylinder is rotatably mounted. The hook drive cams are contoured to time the operation of the hooks to the insertion and withdrawal of the midpart of the paper section into and out of the jaw cavity in the jaw cylinder. The paper section can therefore be held positively retained in the jaw cavity against the risk of accidental disengagement while being folded. The hooks will not cause ink offset between the contacting surfaces of the paper section as they mostly engage the margins of the printings.

The provision of a fixed and a movable jaw in the jaw cavity in the jaw cylinder, as in the prior art, is nevertheless preferable from the stand-point of creation of a well-defined fold on each paper section. A creation of neat folds is desirable to expedite the subsequent processing of the paper sections or signatures. Such jaws, however, may be pressurized only to an extent necessary for folding rather than for retaining the paper section against detachment. Ink offset is therefore not to be caused by the jaws, either.

The above and other objects, features and advantages of this invention will become more apparent, and the invention itself will best be understood, from a study of the following description and appended claims, with reference had to the attached drawings showing the preferred embodiments of the invention.

DESCRIPTION OF THE PREFERRED EMBODIMENTS

Folding Station

Figure 1:
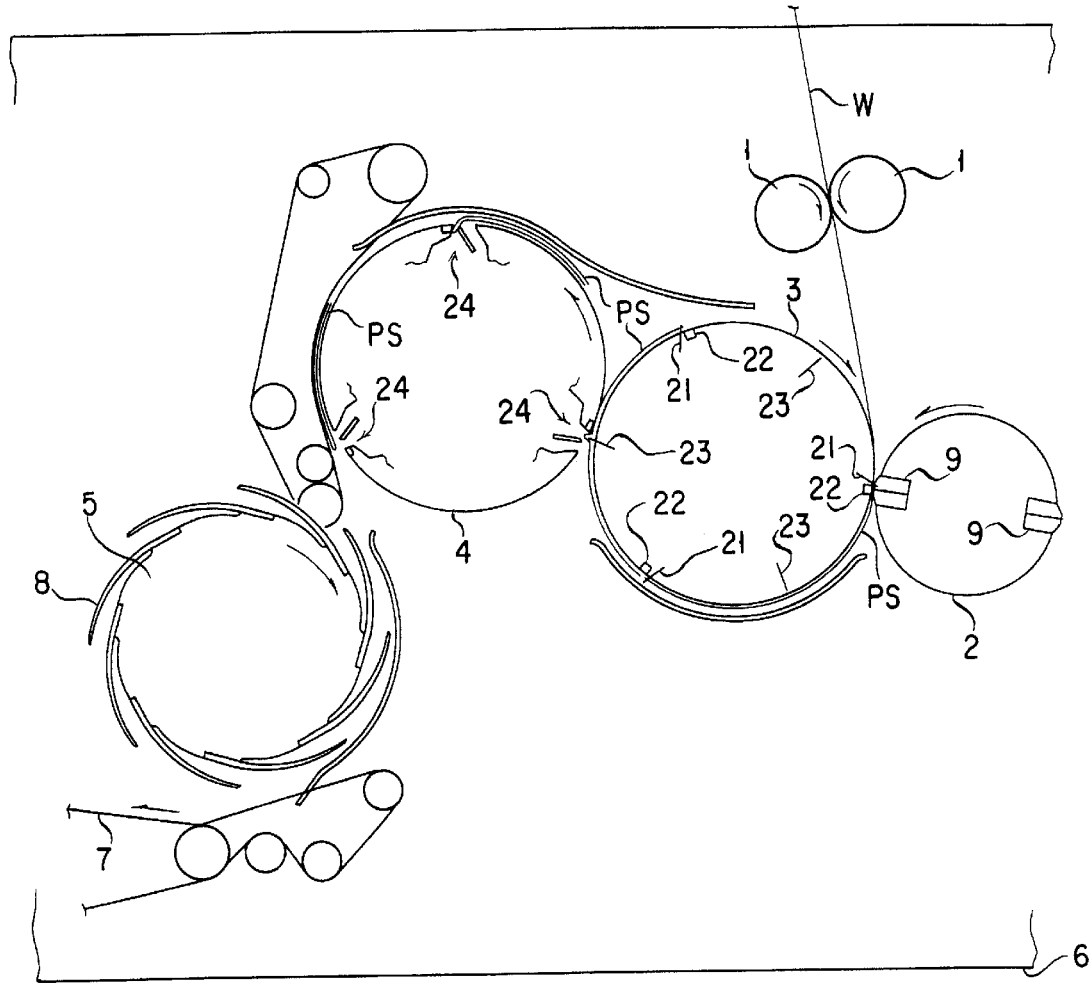
FIG. 1 is a diagrammatic illustration of the folding station of a web-fed printing press including a jaw cylinder to which is applicable the present invention.

The present invention is applicable to the folding station of a rotary printing press that incorporates either one printing unit, or two or more such units for concurrently printing as many webs of paper which are to be subsequently placed one upon another and jointly cut and folded into multiple-page signatures at the same folding station. As illustrated diagrammatically in FIG. 1, the exemplified folding station has a pair of feed rollers 1 for frictionally introducing a web or webs W of printed paper into the folding station. Although in practice a plurality of webs may be concurrently printed as aforesaid and introduced in superposition into the folding station, it is assumed for simplicity of description that only one printed web W is now being printed and fed into the folding station. The usual practice in the art is to fold the printed web longitudinally as by a former, not shown, which is positioned immediately upstream of the folding station.

The folding station has a cutting cylinder 2, a folding cylinder 3, a jaw cylinder 4, and a delivery fan 5, for cutting the printed web W into sections PS of predetermined length, folding each paper section across the middle into a signature, and delivering the successive signatures. All the listed cylinders 2–4 and fan 5 are rotatably mounted between a pair of confronting framing walls 6, one shown in outline in FIG. 1. A delivery conveyor system 7 underlies the delivery fan 5.

The cutting cylinder 2 has one or more, two shown, cutting blades 9 in circumferentially spaced-apart positions thereon, with each blade extending parallel to the cutting cylinder axis. The folding cylinder 3 has a plurality of, three in this embodiment, anvils or beds 22 at constant circumferential spacings on its surface for mating engagement with the successive cutting blades 9 on the cutting cylinder 2. Rows of retractable piercing pins 21 are also mounted to the surface of the folding cylinder 3, in positions immediately upstream of the anvils 22 with respect to the arrow-marked direction of rotation of the folding cylinder. Wrapped around part of the folding cylinder 3, the web W will be engaged by the successive rows of piercing pins 21 and cut transversely into sections PS as the two cutting blades 9 on the cutting cylinder 2 alternately engage with the successive anvils 22 on the folding cylinder 3. The paper sections PS will then ride over the folding cylinder 3 with their leading edges held engaged by the piercing pins 21.

The jaw cylinder 4, which is shown to be of the same diameter as the folding cylinder 3, has defined in its surface a plurality of, three in this embodiment, jaw cavities 24 at constant circumferential spacings. Carried by the folding cylinder 3 to a position opposite one of the jaw cavities 24 in the jaw cylinder 4, each paper section PS will have its leading edge released from one set of piercing pins 21 as the latter then retract into the folding cylinder 3.

Approximately concurrently, the paper section PS will have its mid-part pushed by one of folding blades 23 on the folding cylinder 3 off its surface into one of the jaw cavities 24 in the jaw cylinder 4. As the inserted midpart of the paper section becomes somewhat loosely folded in the jaw cavity, this fold will have its pair of opposite edges caught by fold hooking means constituting the gist of this invention, thereby to be retained in the jaw cavity while the paper section is being subsequently wholly doubled over itself. Additionally, in the illustrated embodiment of the invention, the inserted midpart of the paper section PS as well as the tip of the folding blade 23 will be lightly caught by one set of fixed and movable creasing jaws in the jaw cavity. The jaws will also be set forth in detail presently.

The folding blade 23 will withdraw immediately thereafter into the folding cylinder 3 out of engagement with the jaws, leaving behind the paper section PS retained by the fold hooking means and captured by the jaws. As the folding cylinder 3 and jaw cylinder 4 continue rotation in opposite directions, the paper section PS will transfer from folding cylinder onto jaw cylinder and, by so doing, be folded along its centerline.

Positioned between jaw cylinder 4 and delivery conveyor system 7, the delivery fan 5 has a plurality of vanes 8 of arcuate cross section mounted slantingly on its surface at circumferential spacings to define pockets for receiving the folded paper sections or signatures PS. The signatures are to drop successively by gravity from the jaw cylinder 4 into these pockets on the delivery fan 5 and thence, after riding through a preassigned angle thereon, onto the delivery conveyor system 7.

The construction of the folding station as so far outlined with reference to FIG. 1 is largely conventional except for some parts of the jaw cylinder 4 notably including the fold hooking means. The novel features of the invention will appear in the course of the following more detailed description of the jaw cylinder, the jaws together with their drive means and spacing adjustment means, and the fold hooking means.

Jaw Cylinder

Figure 2:
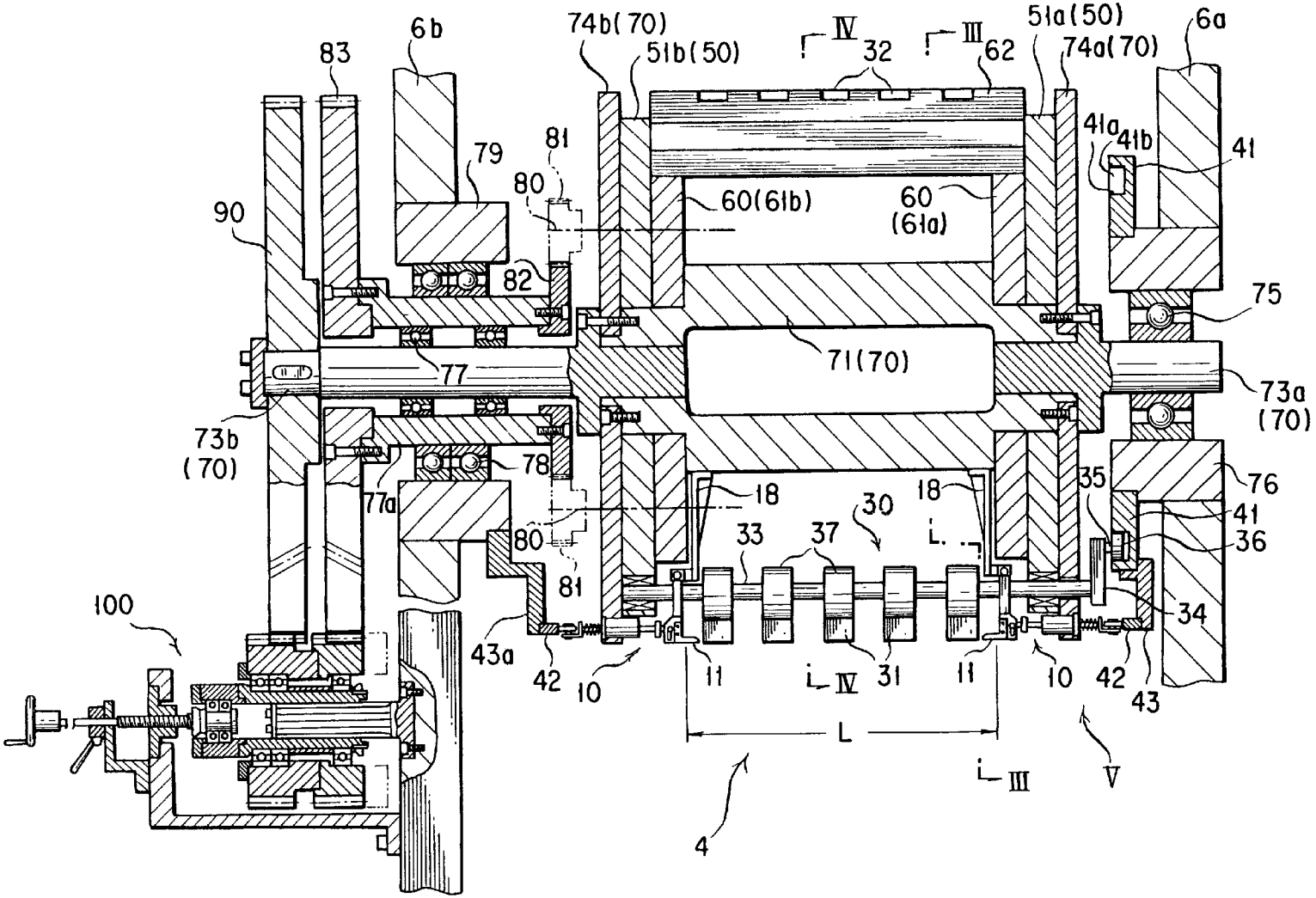
FIG. 2 is an enlarged, fragmentary, sectional view, with parts shown broken away to reveal other parts, of the jaw cylinder of FIG. 1, the section being taken along the planes indicated by the line II—II in FIG. 3.
Figure 3:
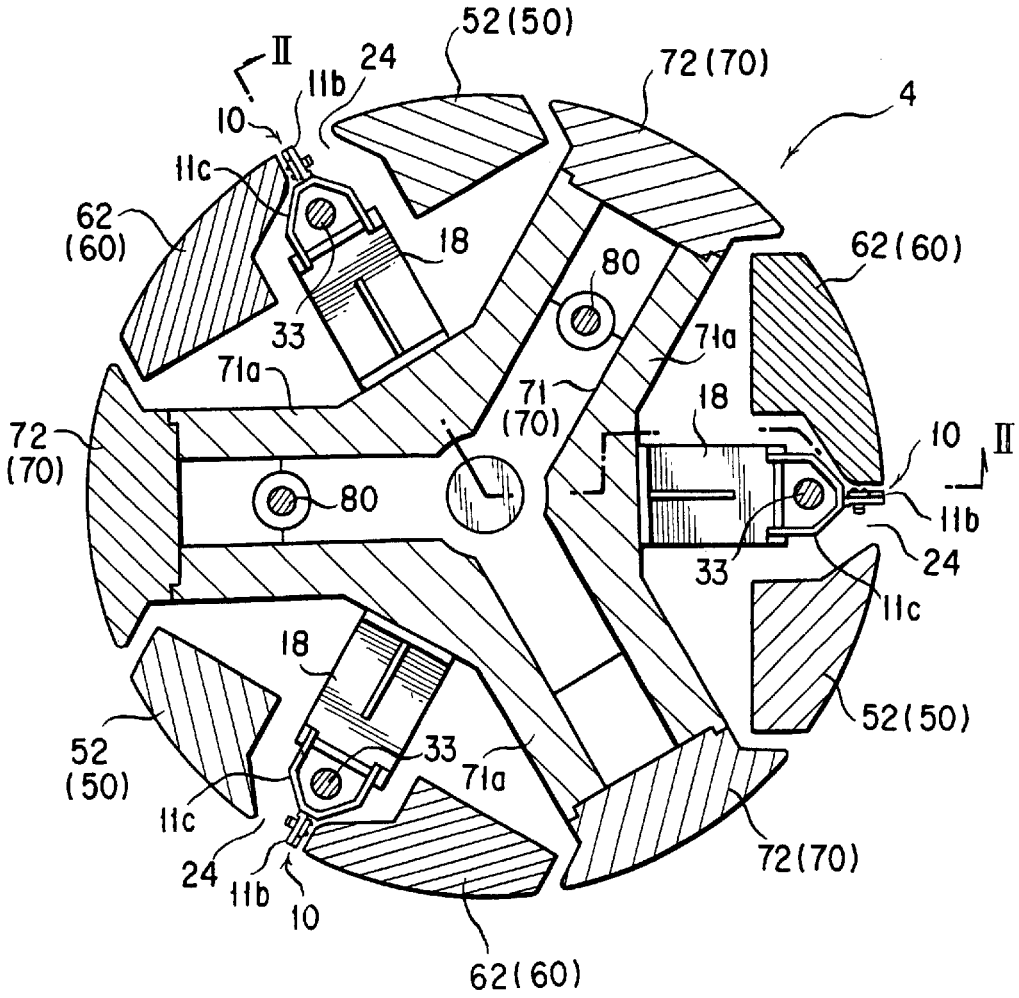
FIG. 3 is a transverse section through the jaw cylinder, taken along the line III—III in FIG. 2.
Figure 4:
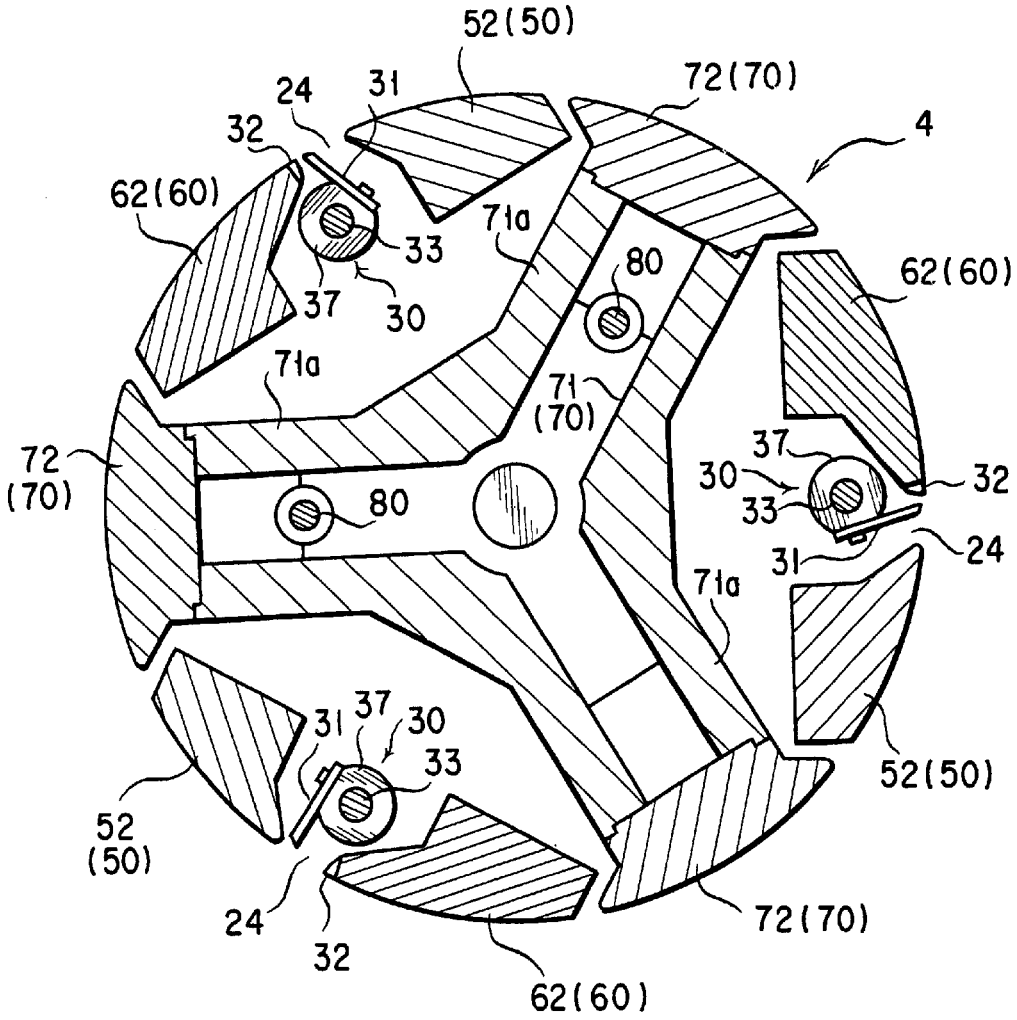
FIG. 4 is another transverse section through the jaw cylinder, taken along the line IV—IV in FIG. 2.

The jaw cylinder 4 is shown in enlarged sections in FIGS. 2–4. Broadly, the jaw cylinder 4 is constituted of the following three parts which are each of substantially one-piece construction:

1. An outer end part 50 including a pair of outer end plates $\mathbf{51}_a$ and $\mathbf{51}_b$.

2. An inner end part 60 including a pair of inner end plates $\mathbf{61}_a$ and $\mathbf{61}_b$.
3. A core part 70 which forms the core of the jaw cylinder 4 and upon which both outer end part 50 and inner end part 60 are concentrically mounted for independent rotation within limits.

The outer end part 50 of the jaw cylinder 4 additionally includes a plurality of, three shown in both FIGS. 3 and 4, ties 52 joining the noted pair of outer end plates $\mathbf{51}_a$ and $\mathbf{51}_b$. Extending parallel to the axis of the jaw cylinder 4, the ties 52 form parts of the jaw cylinder surface. The inner end part 60 of the jaw cylinder 4 likewise additionally comprises a plurality of, three shown, ties 62 joining the pair of inner end plates $\mathbf{61}_a$ and $\mathbf{61}_b$ and forming parts of the surface of the jaw cylinder 4. It will be observed from FIGS. 3 and 4 that the outer end part ties 52 and inner end part ties 62 are arranged alternately. Each neighboring pair of outer end part tie 52 and inner end part tie 62 are spaced from each other circumferentially of the jaw cylinder 4 to define one of the three jaw cavities 24 which were set forth in connection with FIG. 1. Jaw means 30 are mounted in each of these jaw cavities 24 for engaging and folding each paper section PS, FIG. 1, as its midpart is pushed into the jaw cavity by the folding blade 23 on the folding cylinder 3.

With reference to FIG. 2 the core part 70 of the jaw cylinder 4 has a hollow, larger diameter portion 71 with a pair of hollow, smaller diameter portions coaxially extending from its opposite ends. The larger diameter portion 71 of the core part 70 is shown to have three hollow wings $\mathbf{71}_a$, FIGS. 3 and 4, extending radially therefrom at constant circumferential spacings. The hollow wings $\mathbf{71}_a$ have their radially outer ends closed by end caps 72. These end caps form the surface of the jaw cylinder 4 in combination with the outer end part ties 52 and inner end part ties 62. The pair of smaller diameter portions of the core part 70 have rotatably mounted thereon the pair of outer end plates $\mathbf{51}_a$ and $\mathbf{51}_b$ of the outer end part 50 and the pair of inner end plates $\mathbf{61}_a$ and $\mathbf{61}_b$ of the inner end part 60. A pair of cylinder end discs $\mathbf{74}_a$ and $\mathbf{74}_b$ are fastened to the opposite ends of the smaller diameter portions of the core part 70 so as to permit independent angular displacement of the outer end part 50 and inner end part 60 within limits.

Coaxially coupled to the smaller diameter portions of the core part 70 are a pair of journals $\mathbf{73}_a$ and $\mathbf{73}_b$ which are rotatably supported by the pair of confronting framing walls $\mathbf{6}_a$ and $\mathbf{6}_b$. The right-hand journal $\mathbf{73}_a$ is mounted to the right-hand framing wall $\mathbf{6}_a$ via a bearings 75 and bearing sleeve 76. The left-hand journal $\mathbf{73}_b$ is mounted to the left-hand framing wall $\mathbf{6}_b$ via a set of bearings 77, a hollow shaft $\mathbf{77}_a$ around the bearings 77, another set of bearings 78 around the hollow shaft $\mathbf{77}_a$, and a bearing sleeve 79 around the bearings 78.

The left-hand journal $\mathbf{73}_b$ of the jaw cylinder 4 has a drive gear 90 mounted fast on its end projecting outwardly of the framing wall $\mathbf{6}_b$. Coupled to a source of rotary power, not shown, the drive gear 90 is to impart rotation to the core part 70 and hence to the complete jaw cylinder 4. The drive gear 90 takes the form of a helical gear as it is intended to perform additional functions in connection with the adjustment of the jaw spacings.

Jaws and Jaw Drive Means

As will be understood from a consideration of FIGS. 2 and 4, the jaw means 30 in each of the three jaw cavities include a series of movable jaw parts 31 and a series of fixed jaw parts 32. For convenience of description each series of movable jaw parts 31 and each series of fixed jaw parts 32 will be hereinafter referred to collectively as movable jaw and fixed jaw, respectively, individually as movable jaw parts and fixed jaw parts, respectively, and the same reference characters 31 and 32 will be used in both cases. Thus, in this particular embodiment of the invention, the jaw cylinder 4 has three movable jaws 31 and three fixed jaws 32 mounted thereto, with each movable jaw consisting of five movable jaw parts 31, and each fixed jaw consisting of five fixed jaw parts 32.

Each series of fixed jaw parts 32 are affixed to one of the opposite longitudinal edges of each tie 62 of the inner end part 60 of the jaw cylinder 4 defining the jaw cavity 24. Each series of movable jaw parts 31, on the other hand, are mounted to a jaw carrier shaft 33 via movable jaw bases 37 for joint pivotal motion into and out of paper-section-folding engagement with the fixed jaw 32. The jaw carrier shaft 33 itself is rotatably supported by and between the pair of outer end plates $\mathbf{51}_a$ and $\mathbf{51}_b$ of the outer end part 50 of the jaw cylinder 4.

The jaw carrier shaft 33 rotatably extends through the right-hand cylinder end disc $\mathbf{74}_a$ and has a crank arm 34 mounted fast to its projecting end. The crank arm 34 has a crankpin 35 on which a cam follower roller 36 is rotatably mounted for rolling engagement the contoured surface $\mathbf{41}_a$ of a groove $\mathbf{41}_b$ in a jaw drive cam 41 of annular shape. The jaw drive cam 41 is immovably mounted to the framing wall 6a via a bearing sleeve 76.

Thus, with the rotation of the jaw cylinder 4, the cam follower roller 36 is to roll over the contoured cam surface $\mathbf{41}_a$, thereby causing the crank arm 34 to turn bidirectionally. The bidirectional turn of the crank arm 34 will be imparted directly to the jaw carrier shaft 33 and thence to the movable jaw parts 31 via the movable jaw bases 37.

Jaw Spacing Adjustment

As may have been understood from the foregoing, all the series of movable jaw parts 31 are jointly angularly displaceable with the outer end part 50 of the jaw cylinder 4 about the jaw cylinder axis, and so are all the series of fixed jaw parts 32 with the inner end part 60 of the jaw cylinder. Since the outer end part 50 and inner end part 60 are independently rotatable as aforesaid around the core part 70 within limits, the spacings between all the movable jaws 31 and all the fixed jaws 32 are jointly adjustable to the thickness of the paper sections to be folded, by varying the angular positions of the outer end part 50 and inner end part 60 on the core part 70.

The jaw spacing adjustment includes two shafts 80 which are indicated by dot-and-dash lines in FIG. 2 and by solid-line sections in FIGS. 3 and 4. Extending parallel to the axis of the jaw cylinder 4, the jaw spacing adjustment shafts 80 are coupled respectively to the pair of outer end plates $\mathbf{51}_a$ and $\mathbf{51}_b$ and to the pair of inner end plates $\mathbf{61}_a$ and $\mathbf{61}_b$ via cams, not shown, such that the rotation of the shafts 80 is translated into the angular displacement of the outer end part 50 and inner end part 60 relative to the core part 70.

Mounted fast to the jaw spacing adjustment shaft 80 are pinions 81 which are both in mesh with a gear 82 on the aforesaid hollow shaft $\mathbf{77}_a$. A helical gear 83 is also mounted to the hollow shaft 77, for joint rotation with the gear 82. The helical gears 83 and 90 are both in mesh with the helical pinions of the known jaw spacing adjustment gear means 100 whereby the relative angular positions of the helical gears 83 and 90 are adjustably variable. A change in the relative angular positions of the helical gears 83 and 90 results in the rotation of the pinions 81 relative to the jaw cylinder 4 and hence, via the unshown cams, in the joint angular displacement of the outer end part 50 and inner end part 60 relative to the core part 70. Thus the spacings between the three movable jaws 31 and three fixed jaws 32 are concurrently adjustable to the thickness of the paper sections to be engaged therebetween.

Fold Hooking Means

FIG. 2 indicates that the fold hooking means 10 are provided in a pair in each of the three jaw cavities in the jaw cylinder 4 for engaging the opposite edges of the folded midpart of the paper section. Since the pair of fold hooking means are substantially alike in construction, only the right-hand fold hooking means will be detailed with reference to FIGS. 5 and 6, it being understood that the same description applies to the left-hand fold hooking means except where otherwise indicated specifically.

The right-hand fold hooking means 10 have a thrust rod 12 operatively coupled to an L-shaped hook 11. Extending parallel to the axis of the jaw cylinder 4, the thrust rod 12 is slidably received in a guide sleeve 13 via antifriction linings $\mathbf{13}_a$. The guide sleeve 13 is mounted fast to the right-hand cylinder end disc $\mathbf{74}_a$ for joint rotation with the jaw cylinder 4. One end of the thrust rod 12 has affixed thereto an L-shaped bracket $\mathbf{12}_b$ to which a cam follower roller 15 is rotatably mounted via a spindle 14 extending radially of the jaw cylinder 4. The cam follower roller 15 is urged against a stationary hook drive cam 42 by a helical compression spring 16 sleeved upon the thrust rod 12. The hook drive cam 42 is of arcuate shape centered about the axis of the jaw cylinder 4 and is secured to a cam mount 43 which in turn is secured to the right-hand framing wall $\mathbf{6}_a$ via the jaw drive cam 41 and the bearing sleeve 76. As will be understood from FIG. 6, the hook drive cam 42 is contoured to cause the thrust rod 12 to travel axially against the bias of the compression spring 16 in a prescribed angular phase of the jaw cylinder 4 relative to the framing walls $\mathbf{6}_a$ and $\mathbf{6}_b$.

A reference back to FIG. 2 will show that the jaw drive cam 41 is mounted only to the right-hand framing) wall $\mathbf{6}_a$. A cam mount $\mathbf{43}_a$ of different shape is therefore provided for directly mounting the left hand hook drive cam 42 to the bearing sleeve 79.

With reference again to FIGS. 5 and 6, and particularly to FIG. 6, the bracket $\mathbf{12}_b$ carrying the cam follower roller 15 has a pin $\mathbf{12}_c$ projecting therefrom at right angles with the axes of both thrust rod 12 and cam follower roller 15. The pin $\mathbf{12}_c$ is slidably received in a slot $\mathbf{19}_a$ which is defined by a guide 19 fastened to the jaw cylinder end disk $\mathbf{74}_a$ and which extends parallel to the thrust rod 12. Thus is the thrust rod 12 constrained to linear longitudinal travel as dictated by the hook drive cam 42, without undergoing angular displacement about its own axis during such travel.

Figure 5:
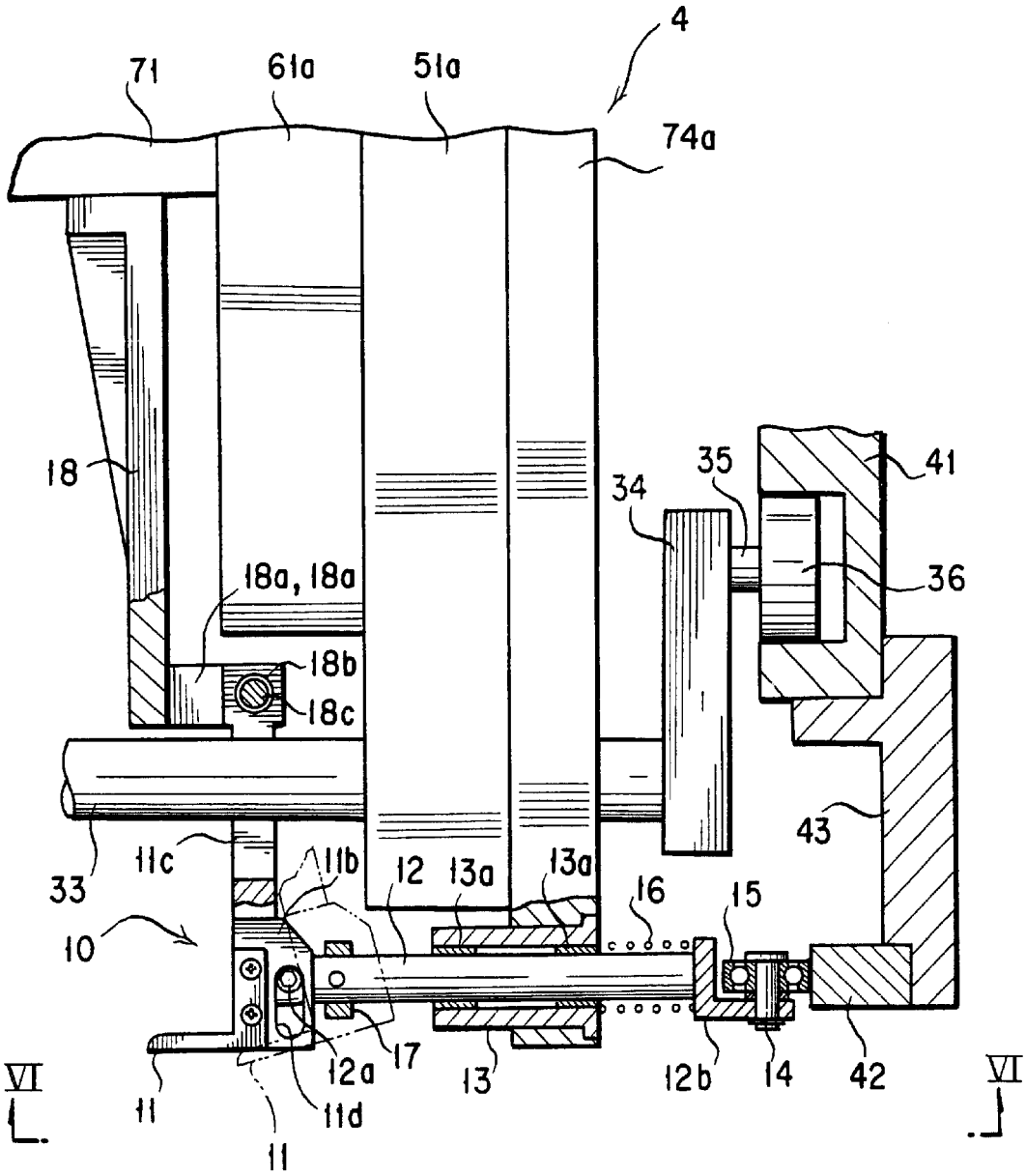
FIG. 5 is an enlargement of that part of the showing of FIG. 2 which is indicated by the arrow V in that figure, the view showing in particular one of the pair of hooks and associated hook drive means.
Figure 6:
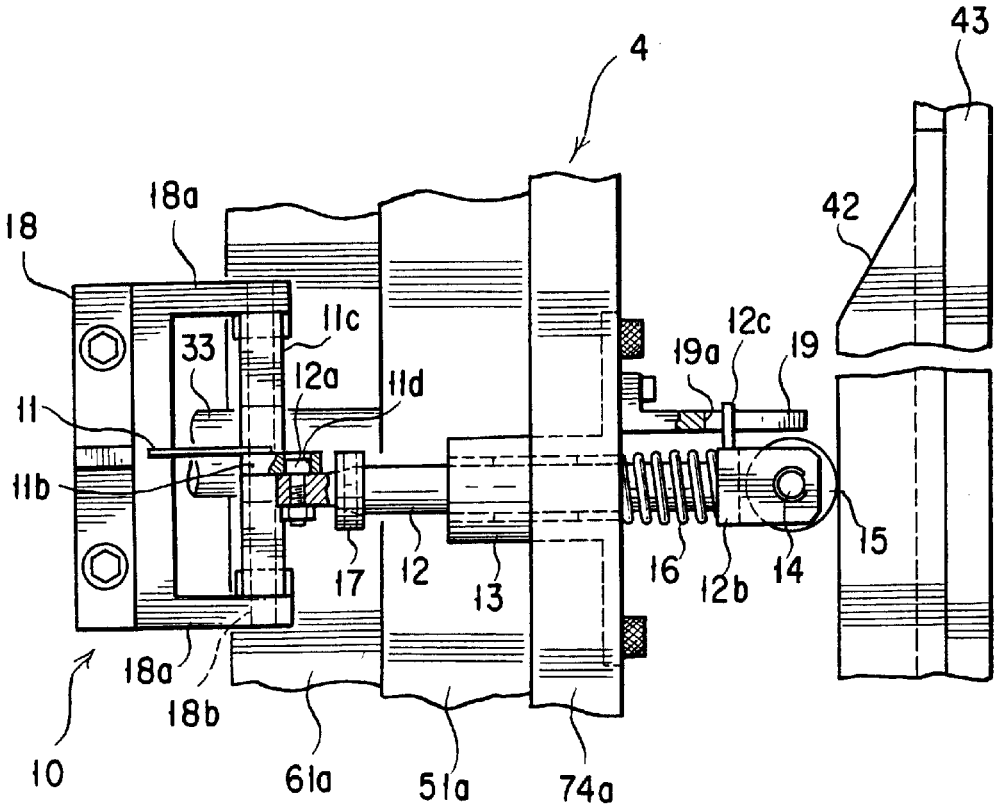
FIG. 6 is an illustration of the showing of FIG. 5 as seen in the direction indicated by the arrows VI in that figure.

At 17 is seen a collar mounted to the thrust rod 12 in order to limit the travel of the thrust rod to the right, as viewed in FIGS. 5 and 6, under the bias of the compression spring 16 when the cam follower roller 15 is not held against the hook drive cam 42. This collar 17 will be unnecessary if the hook drive cam 42 is annular in shape, instead of arcuate as shown, itself limiting the rightward travel of the thrust rod 12.

Beside being coupled to the thrust rod 12 in a manner yet to be described, the hook 11 is operatively supported on the larger diameter portion 71 of the core part 70 of the jaw cylinder 4. Mounted fast to the core part larger diameter portion 71 is a bracket 18 extending radially outwardly therefrom and terminating in a pair of bifurcations $\mathbf{18}_a$ which are bent right-angularly therefrom. A pivot pin $\mathbf{18}_b$ extends between these bifurcations $\mathbf{18}_a$, and a U-shaped swing arm $\mathbf{11}_c$ is pivotally mounted to the pivot pin $\mathbf{18}_b$ via sleeve bearings $\mathbf{18}_c$. The swing arm $\mathbf{11}_c$ is U shaped in order to be installed astride the jaw carrier shaft 33 with substantial clearance. A hook carrier $\mathbf{11}_b$ is mounted fast to the free end of the swing arm $\mathbf{11}_c$, and the L-shaped hook 11 is fastened to the hook carrier $\mathbf{11}_b$. The hook carrier $\mathbf{11}_b$ is operatively coupled to the thrust rod 12 by slidably receiving a lateral projection $\mathbf{12}_a$, shown as a bolt head, on the thrust rod in a slot $\mathbf{11}_d$ cut in the hook carrier.

Thus, with the linear reciprocation of the thrust rod 12 under the direction of the hook drive cam 42, the swing arm 11*c* will turn about the pivot pin $\mathbf{18}_b$ thereby causing the hook 11 to travel between the solid-line working position and phantom retracted position of FIG. 5. Upon actuation to the working position the hook 11 will enter the region L, FIG. 2, to be occupied by the paper section PS on having its midpart inserted in the jaw cavity 24, in order to be received in the space bounded by the loosely folded midpart of the paper section.

Operation

As the printing press is set into operation, the cutting cylinder 2, folding cylinder 3, jaw cylinder 4 and delivery fan 5 of the FIG. 1 folding station will all rotate in the arrow-marked directions at the same peripheral speed. Traveling over the folding cylinder 3, the printed web W will be cut into successive sections PS by the cutting blades 9 on the cutting cylinder 2 in cooperation with the anvils 22 on the folding cylinder.

In a position angularly spaced half a revolution of the folding cylinder from where the web W is cut as above, each paper section PS will have its midpart placed opposite one of the jaw cavities 24 in the jaw cylinder 4. One of the folding blades 23 on the folding cylinder 3 will then push this midpart of the paper section PS into the jaw cavity 24. There-upon the pair of fold hooking means 10 in this jaw cavity will operate in the following fashion to thrust the hooks 11 into the loose fold created by the midpart of the paper section PS on being inserted as above into the jaw cavity.

In the right-hand fold hooking means 10 shown in FIGS. 5 and 6, for example, the cam follower roller 15 will ride onto and off the hook drive cam 42 with the rotation of the jaw cylinder 4. The hook 11 will stay in the phantom retracted position of FIG. 5 under the force of the compression spring 16 when the cam follower roller 15 is off the hook drive cam 42. The cam follower roller 15 on riding onto the hook drive cam 42 will cause the thrust rod 12 to travel linearly to the left against the force of the compression spring 16. No rotation of the thrust rod 12 will occur during such travel as the pin $\mathbf{12}_c$, FIG. 6, projecting laterally therefrom slides through the guide slot $\mathbf{19}_a$.

The leftward thrust of the thrust rod 12 will be transmitted via its lateral projection $\mathbf{12}_a$ to the hook carrier $\mathbf{11}_b$, resulting in the joint pivotal motion of the hook 11, hook carrier $\mathbf{11}_b$ and swing arm $\mathbf{11}_c$ about the pivot pin $\mathbf{18}_b$ on the pair of bifurcations $\mathbf{18}_a$ of the bracket 18. Thus the hook 11 will travel to the solid-line working position of FIG. 5 and so enter the space bounded by the loosely folded midpart of the paper section which has been inserted in the jaw cavity 24. The left-hand fold hooking means 10 will operate in a like manner, causing the left-hand hook to enter the space in the folded midpart of the paper section from its left-hand end.

After the insertion of the midpart of each paper section PS in the jaw cavity 24, and in prescribed time relationship to the hooking of the paper section by the pair of hooks 11, the jaw means 30 will operate to engage and fold the midpart. The movable jaw 31 in this jaw cavity will then pivot on the jaw carrier shaft 33 to press the inserted midpart of the paper section PS against the fixed jaw 32 together with the folding blade 23 on the folding cylinder 3. The movable jaw 31 will be so actuated as the crank arm 34, FIGS. 2 and 5, on the jaw carrier shaft 33 is caused to turn in the required direction by the jaw drive cam 41 with which the cam follower roller 36 on the crankpin 35 travels in constant rolling engagement with the rotation of the jaw cylinder 4. The jaw carrier shaft 33 will turn with the crank arm 34 against the force of the unshown torsion-bar spring built into it.

Following the insertion of the pair of hooks 11 into the folded midpart of the paper section PS and engagement of the midpart of the paper section between the jaws 31 and 32, the folding blade 23 will withdraw out of the jaw cavity 24 in the jaw cylinder and retract into the folding cylinder. Then the movable jaw 31 will be sprung to press the midpart of the paper section more closely against the fixed jaw 32 and hence to fold the same along its centerline.

The insertion of the midpart of one paper section PS by one folding blade 23 on the folding cylinder 3 into one jaw cavity 24 in the jaw cylinder 4, the hooking of the opposite ends of the inserted midpart of the paper section by one associated pair of fold hooking means 10, and the engagement of the inserted midpart of the paper section between one associated pair of jaws 32 and 33, will be repeated with each one third of a revolution of these cylinders 3 and 4. With the continued rotation of the folding cylinder 3 and jaw cylinder 4 in opposite directions, each paper section PS will be pulled off the surface of the folding cylinder 3, ride onto the jaw cylinder 4, and, by so doing, be folded as its leading half is placed over the trailing half on the jaw cylinder.

It is to be appreciated that while being folded as above, each paper section has its fold caught by the pair of hooks 11 beside being engaged by the jaw means 30. The movable jaw 31 need not press the paper section against the fixed jaw 32 so hard as in the absence of the fold hooking means 10, but only to an extent necessary for folding.

The paper section PS will ride over the jaw cylinder 4 during approximately two thirds of a revolution thereof in this embodiment of the invention. Then the cam follower rollers 15, FIGS. 5 and 6, of the pair of fold hooking means 10 will both go out of engagement with the hook drive cams 42, with the consequent retraction of the thrust rods 12 under the forces of the compression springs 16. The pair of hooks 11 will withdraw from within the folded midpart of the paper section, turn back to the phantom retracted position of FIG. 5, and be retained there as the collars 17 on the thrust rods 12 come into abutment against the guide sleeves 13. The collars 17 will be unnecessary, however, if the hook drive cams 42 each are extended into annular shape to limit the return stroke of the thrust rod 12.

Substantially concurrently with such retraction of the hooks 11, the crank arm 34, FIGS. 2 and 5, on the jaw carrier shaft 33 will turn under the influence of the jaw drive cam 41 to cause the movable jaw 31 to pivot away from the fixed jaw 32. Released from both the hooks 11 and the jaws 31 and 32, the folded paper section PS will fall by gravity off the surface of the jaw cylinder 4 into one of the pockets defined by the slanting vanes 8, FIG. 1, on the delivery fan 5. This delivery fan is in constant rotation in a clockwise direction as viewed in FIG. 1. The vanes 8 are so angled with respect to this rotational direction of the delivery fan 5 that the folded paper section PS will subsequently slide down the vane onto the underlying delivery conveyor system 7 thereby to be transported toward a place of shipment.

Second Form

Figure 7:
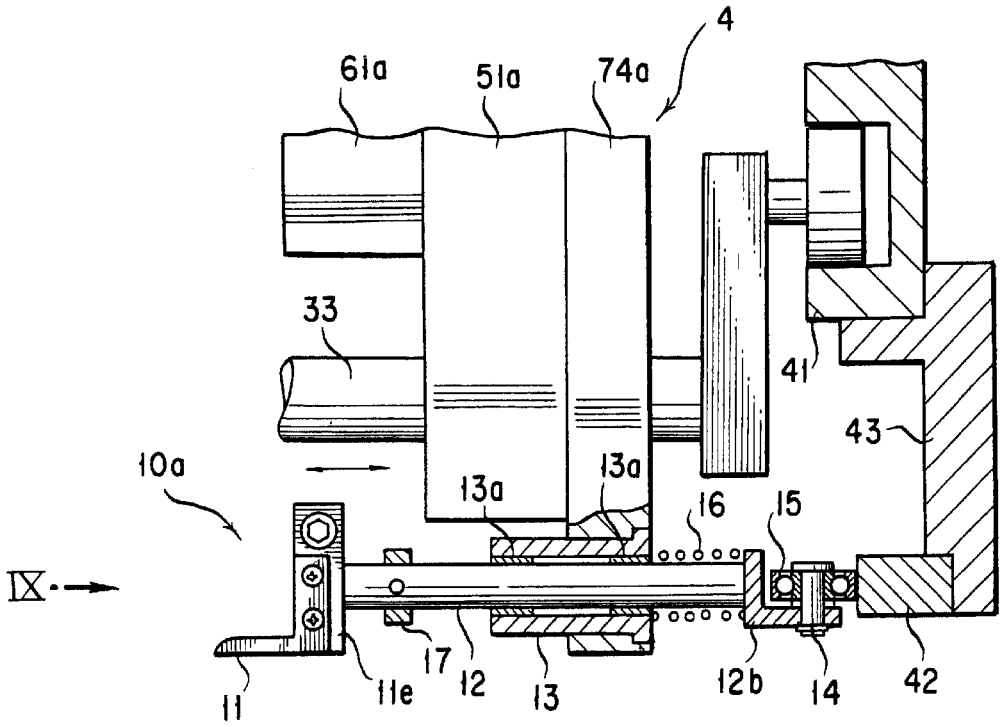
FIG. 7 is a view similar to FIG. 5 but showing another preferred form of hooking means according to the invention.
Figure 8:
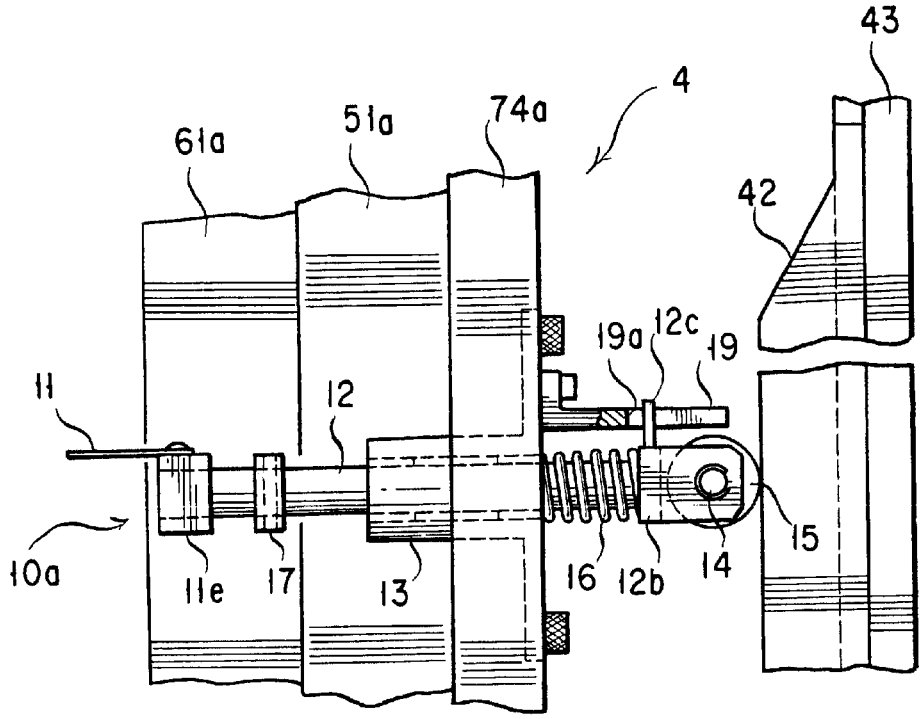
FIG. 8 is a view similar to FIG. 6 but showing the modified hooking means of FIG. 7.
Figure 9:
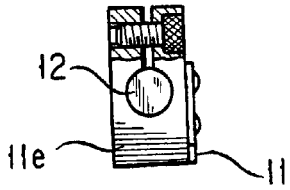
FIG. 9 shows the modified hooking means of FIG. 7 as seen in the direction of the arrow IX in that figure.

FIGS. 7-9 illustrate another preferred form of fold hooking means $\mathbf{10}_a$ according to the invention. These figures show only one of the pair of means for hooking the opposite ends of the folded midpart of each paper section, it being understood that like means are provided for engaging the other end of the folded midpart.

The modified fold hooking means differ from their FIGS. 5–6 counterpart in that the thrust rod 12 is coupled directly and rigidly to the hook carrier $\mathbf{11}_e$ and thence to the hook 11. Thus the hook 11 travels linearly back and forth with the thrust rod 12 into and out of the folded midpart of the paper section. All the other details of construction are as previously set forth in connection with FIGS. 5 and 6. The operation of the modified fold hooking means in conjunction with the other working parts of the jaw cylinder 4, or with the other components of the folding station, is considered self-evident from the foregoing description of FIGS. 1–6.

Notwithstanding the foregoing detailed disclosure it is not desired that the present invention be limited by the exact showing of the appended drawings or by the description thereof. It is therefore appropriate that the invention be construed broadly and in a manner consistent with the fair meaning or proper scope of the claims which follow.

What is claimed is:

1. In a folding station of a web-fed printing press where a web of printed paper is cut into sections by a cutting cylinder while riding on a folding cylinder, and wherein each paper section has its midpart pushed by a folding blade on the folding cylinder into a jaw cavity in a jaw cylinder in order to be folded into the form of a signature while being transferred from the folding cylinder onto the jaw cylinder, the jaw cavity being formed in the surface of the jaw cylinder and extending parallel to the axis thereof, the jaw cylinder comprising:

(a) a pair of hooks mounted adjacent a pair of opposite ends of the jaw cavity in the jaw cylinder for movement into and out of a space created by the midpart of each paper section upon insertion in the jaw cavity; and (b) hook drive means for causing the hooks to enter the space bounded by the midpart of each paper section when the same is inserted in the jaw cavity, and to withdraw from the space after the paper section has been folded on the jaw cylinder;

(c) whereby each paper section has its midpart retained in the jaw cavity in the jaw cylinder by the pair of hooks while being folded.

2. The invention of claim 1 wherein the jaw cylinder is rotatably mounted to frame means, and wherein the hook drive means for each hook comprises:

(a) a hook drive cam mounted to the frame means;

(b) a thrust rod coupled to the hook and mounted to the jaw cylinder for linear motion parallel to the axis of the jaw cylinder; and (c) cam follower means acting between the hook drive cam and the thrust rod to cause the linear motion of the thrust rod, and hence the movement of the hook into and out of the space bounded by the midpart of the paper section, in response to the rotation of the jaw cylinder relative to the frame means.

3. The invention of claim 2 wherein each hook is mounted fast to swing arm means which in turn is pivotally mounted to the jaw cylinder for carrying the hook into and out of the space bounded by the midpart of the paper section, and wherein the thrust rod is operatively coupled to the swing arm means.

4. The invention of claim 2 wherein the thrust rod is rigidly coupled to the hook for linearly transporting the same into and out the space bounded by the midpart of each paper section.

5. In a folding station of a web-fed printing press where a web of printed paper is cut into sections by a cutting cylinder while riding on a folding cylinder, and wherein each paper section has its midpart pushed by a folding blade on the folding cylinder into a jaw cavity in a jaw cylinder in order to be folded into the form of a signature while being transferred from the folding cylinder onto the jaw cylinder, the jaw cavity being formed in the surface of the jaw cylinder and extending parallel to the axis thereof, the jaw cylinder comprising:

(a) a pair of hooks mounted adjacent a pair of opposite ends of the jaw cavity in the jaw cylinder for movement into and out of a space created by the midpart of each paper section upon insertion in the jaw cavity; and (b) hook drive means for causing the hooks to enter the space bounded by the midpart of each paper section when the same is inserted in the jaw cavity, and to withdraw from the space after the paper section has been folded on the jaw cylinder;

(c) jaw means mounted in the jaw cavity in the jaw cylinder for engaging and folding the midpart of each paper section inserted in the jaw cavity; and (d) jaw drive means for causing the jaw means to engage the midpart of each paper section in prescribed time relationship to the hooking thereof by the pair of hooks, and to disengage the midpart of each paper section after the paper section has been folded;

(e) whereby each paper section has its midpart retained in the jaw cavity in the jaw cylinder by the pair of hooks while being folded, so that the jaw means is required to engage the midpart of the paper section hard enough only to create a fold.

6. The invention of claim 5 wherein the jaw means comprises:

(a) a fixed jaw fixedly mounted to the jaw cylinder;

(b) a jaw carrier shaft rotatably mounted to the jaw cylinder and coupled to the jaw drive means thereby to be driven bidirectionally; and (c) a movable jaw fixedly mounted to the jaw carrier shaft for pivotal motion toward and away from the fixed jaw.

7. The invention of claim 6 wherein the jaw cylinder is rotatably mounted to frame means, and wherein the hook drive means for each hook comprises:

(a) a hook drive cam mounted to the frame means;

(b) a thrust rod mounted to the jaw cylinder for linear motion parallel to the axis of the jaw cylinder;

(c) a U-shaped swing arm pivotally mounted to the jaw cylinder astride the jaw carrier shaft and operatively coupled to the thrust rod, the swing arm having the hook formed thereon; and (d) cam follower means acting between the hook drive cam and the thrust rod to cause the linear motion of the thrust rod, hence the pivotal motion of the swing arm, and hence the movement of the hook into and out of the space bounded by the midpart of the paper section, in response to the rotation of the jaw cylinder relative to the frame means.

8. The invention of claim 5 wherein the jaw cylinder is rotatably mounted to frame means, and wherein the hook drive means for each hook comprises:

(a) a hook drive cam mounted to the frame means;

(b) a thrust rod mounted to the jaw cylinder for linear motion parallel to the axis of the jaw cylinder and having the hook formed thereon; and (c) cam follower means acting between the hook drive cam and the thrust rod to cause the linear motion of the thrust rod and hence of the hook into and out of the space bounded by the midpart of the paper section.

* * * * *